US012728310B2

(12) United States Patent
Lee

(10) Patent No.: US 12,728,310 B2
(45) Date of Patent: Sep. 8, 2026

(54) ARTICULATING ARM FOR EXERCISE APPARATUS

(71) Applicant: Byung-Ho Lee, Woodbridge (CA)

(72) Inventor: Byung-Ho Lee, Woodbridge (CA)

( * ) Notice: Subject to any disclaimer, the term of this patent is extended or adjusted under 35 U.S.C. 154(b) by 55 days.

(21) Appl. No.: 18/882,973

(22) Filed: Sep. 12, 2024

(65) Prior Publication Data

US 2026/0069919 A1 Mar. 12, 2026

(51) Int. Cl.
*A63B 21/00* (2006.01)
*A63B 21/062* (2006.01)

(52) U.S. Cl.
CPC ..... *A63B 21/4047* (2015.10); *A63B 21/062* (2013.01); *A63B 21/154* (2013.01)

(58) Field of Classification Search
CPC ..... A63B 21/062; A63B 21/0622; A63B 21/0624; A63B 21/154; A63B 21/156; A63B 21/159; A63B 21/4047; A63B 22/0046; A63B 2210/00; A63B 2210/50; A63B 2225/09; A63B 2225/093
See application file for complete search history.

(56) References Cited

U.S. PATENT DOCUMENTS

| | | | | |
|---|---|---|---|---|
| 12,303,739 | B1 * | 5/2025 | Nolan | A63B 21/4047 |
| 2017/0001067 | A1 * | 1/2017 | Drath | A63B 22/0046 |
| 2024/0350852 | A1 * | 10/2024 | Johnson | A63B 21/4035 |
| 2026/0021336 | A1 * | 1/2026 | Chen | A63B 21/0555 |
| 2026/0021341 | A1 * | 1/2026 | Chen | A63B 21/156 |

FOREIGN PATENT DOCUMENTS

| | | | | |
|---|---|---|---|---|
| CN | 219023120 U | * | 5/2023 | A63B 17/04 |
| DE | 202022103924 U1 | * | 10/2022 | A63B 23/12 |
| DE | 102023002020 A1 | * | 11/2024 | A63B 21/4047 |
| DE | 102023004869 A1 | * | 5/2025 | A63B 23/1209 |
| EP | 4596058 A1 | * | 8/2025 | A63B 21/4035 |
| WO | WO-2025114240 A1 | * | 6/2025 | A63B 22/0002 |

* cited by examiner

*Primary Examiner* — Gary D Urbiel Goldner
(74) *Attorney, Agent, or Firm* — Orin Del Vecchio

(57) ABSTRACT

An articulating arm for lifting weight operably coupled thereto that can be employed for various applications such as but not limited to exercise equipment, wherein the articulating arm is movable in x-axis and y-axis directions. The articulating arm includes a base portion that is operably coupled to a frame. The base portion is mounted to the frame utilizing a pin member wherein the pin member facilitates rotational movement of the base portion in the x-axis direction. The base portion has operably coupled thereto an arm member. The arm member has a first end and a second end wherein the first end is movably coupled to the base portion utilizing a pivot pin member. The pivot pin member facilitates movement of the arm member in the y-axis direction. The arm member has integrally formed therewith on opposing ends pulley housings having pulleys therein operably coupled with a cable.

4 Claims, 2 Drawing Sheets

ARTICULATING ARM FOR EXERCISE APPARATUS

FIELD OF THE INVENTION

The present invention relates generally to exercise equipment and components thereof, more specifically but not by way of limitation, an articulating arm for an exercise apparatus wherein the arm of the present invention is configured to move in a horizontal direction and a vertical direction.

BACKGROUND

As is known in the art, exercise machines are commercially available to assist in the execution of a wide variety of exercises. Existing machines include but are not limited to free weight machines that are configured to receive weighted plates and stacked weight machines wherein the weights are operably coupled to vertical support members moving up and down and operably coupled with a cable system for a user to engage therewith. Existing exercise machines are all equipped with various accessories in order to facilitate execution of a plurality of different exercises. These accessories can include but are not limited to barbell attachments, leg attachments as well as pulley and cable systems.

One element that is commonly employed with cable and pulley systems is an articulating arm member. The arm member is operably coupled to the machine frame and is configured with at least one pulley having a cable operably coupled therewith wherein the opposing ends of the cable are coupled to a weight stack and a user interface. The arm members are typically hingedly mounted so as to facilitate lateral, or horizontal, movement of the arm member. Depending upon the exercise being performed, users may choose to laterally adjust the arm members in order to facilitate execution of the exercise. Conventional arm members employ a hinge pin and a spring pin wherein the spring pin is configured to be operably inserted into a plurality of apertures formed in an arcuate pattern on a support plate. While lateral movement of the arm member is effective, for users of different heights and users desiring an alternate leverage point, vertical adjustment of the arm member is desirable. Currently technology does not facilitate an ability to move an arm member in both a lateral and vertical direction.

Accordingly, there is a need for an articulating arm member configured to be operably coupled to an exercise machine or be employed for alternate applications wherein the arm member of the present invention is configured to be movable in a lateral and a vertical direction.

SUMMARY OF THE INVENTION

It is the object of the present invention to provide an articulating arm member for exercise equipment that is configured to be movable in a first direction and a second direction wherein the present invention includes a base portion.

Another object of the present invention is to provide an arm member configured to be employed to assist a user in moving weight in a plurality of applications wherein the base portion is rotatably coupled to a frame member.

A further object of the present invention is to provide an articulating arm member for exercise equipment that is configured to be movable in a first direction and a second direction wherein the base portion is superposed and adjacent a support plate wherein the support plate includes a plurality of apertures.

Yet a further object of the present invention is to provide an arm member configured to be employed to assist a user in moving weight in a plurality of applications wherein the base portion has pivotally coupled thereto an arm member.

Still another object of the present invention is to provide an articulating arm member for exercise equipment that is configured to be movable in a first direction and a second direction wherein the arm member includes a plurality of apertures adjacent the pivot pin member.

An additional object of the present invention is to provide an arm member configured to be employed to assist a user in moving weight in a plurality of applications wherein the arm member includes a spring pin configured to engage the apertures formed in the arm member.

Yet a further object of the present invention is to provide an articulating arm member for exercise equipment that is configured to be movable in a first direction and a second direction wherein the arm member includes a pulley operably coupled thereto distally located from the base portion.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
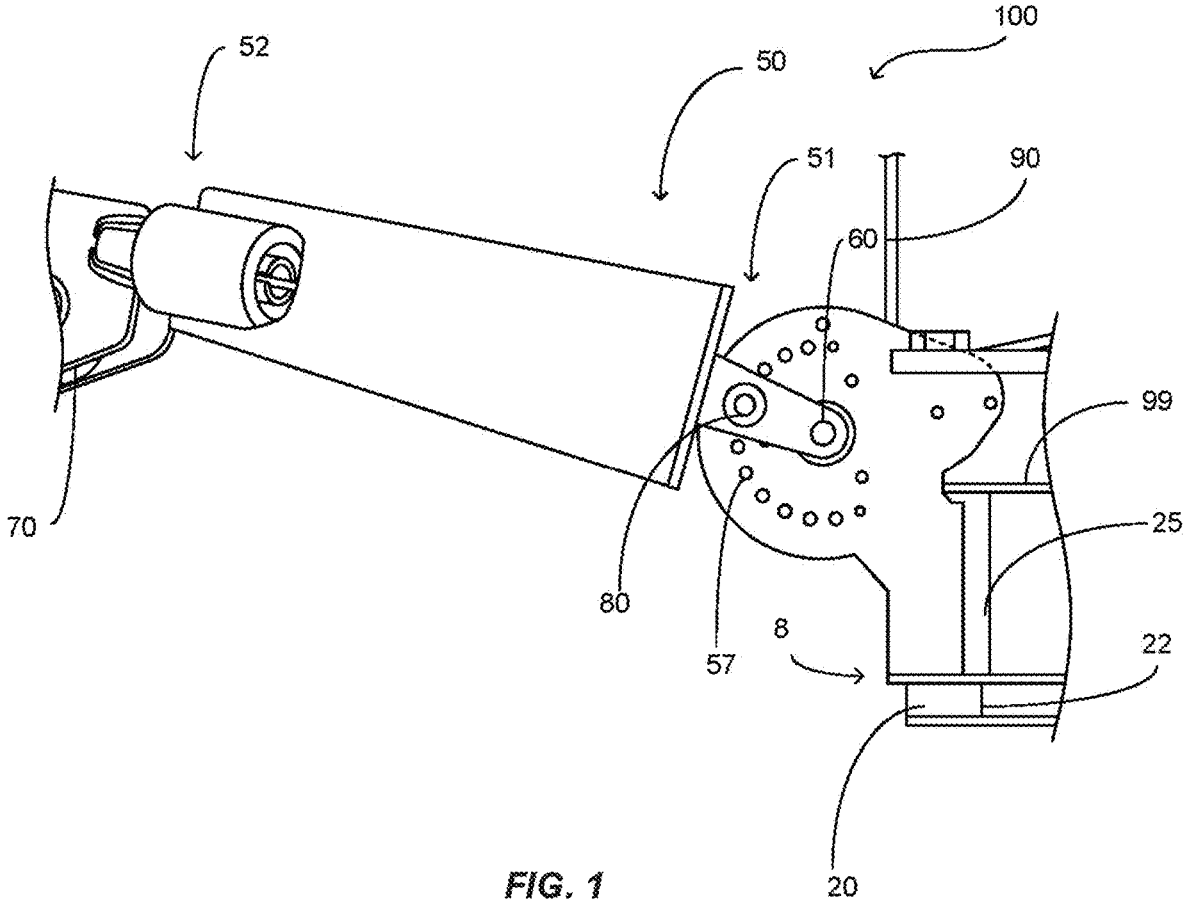
FIG. 1 is a perspective view of the present invention.
Figure 2:
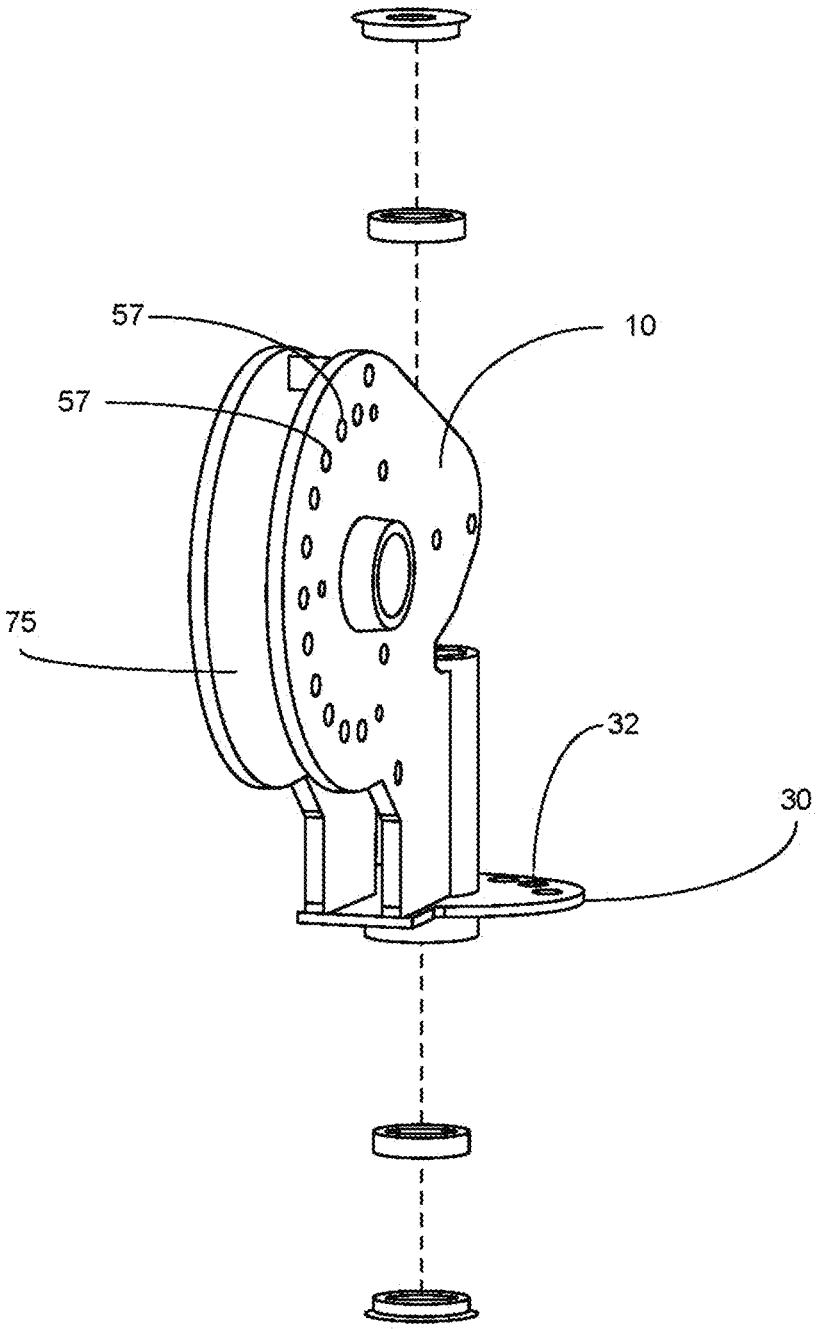
FIG. 2 is a detailed view of the base pulley of the present invention.

Referring now to the drawings submitted herewith, wherein various elements depicted therein are not necessarily drawn to scale and wherein through the views and figures like elements are referenced with identical reference numerals, there is illustrated an articulating arm member 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the articulating arm member 100 is manufactured from durable rigid materials such as but not limited to metal. It should be understood within the scope of the present invention that while a preferred embodiment of the articulating arm member 100 is employed as part of an exercise machine that the articulating arm member 100 could be utilized in alternate applications wherein a weight or mass is required to be lifted. By way of example but not limitation, the articulating arm member 100 could be utilized in various industrial applications.

The articulating arm member 100 includes a base housing 10. The base housing 10 has central void (not particularly illustrated herein) wherein the base housing 10 has first pulley member 75 operably coupled therewithin. The base housing 10 is operably coupled to pin member 20 proximate the first end 8 of the base housing 10. Pin member 20 includes housing 22 wherein housing 22 is secured to frame 99. It should be understood within the scope of the present invention that the frame 99 could be a portion of various apparatus such as but not limited to an exercise machine. The pin member 20 and housing 22 are configured to facilitate rotational movement of the base housing 10 wherein the base housing 10 can rotate with respect to the frame 99 approximately one hundred and eighty degrees.

Base housing 10 has operably coupled therewith locking pin 25. Locking pin 25 is operably coupled to base housing 10 utilizing arm member 27 wherein the locking pin 25 is operable to be moved in an upwards-downwards motion. The locking pin 25 is configured to engage the apertures 32 formed in support plate member 30. Apertures 32 are formed in support plate member 30 utilizing suitable techniques and are arranged in a semi-annular pattern. The support plate member 30 is integrally secured to frame 99 and is perpendicular therewith. As locking pin 25 is released from an aperture 32 pin member 20 facilitates rotational movement of the base housing 10 with respect to frame 99 and as such provides lateral adjustment of the base housing 10 and as such the arm member 50 with respect to the frame. The lateral adjustment of the base housing 10 is the first direction of movement of the articulating arm member 100.

Arm member 50 is operably coupled to the base housing 10 utilizing pivot pin member 60. Arm member 50 includes a first end 51 and second end 52. Arm member 50 has integrally formed therewith first pulley member 75 and second pulley member 70 having cable 90 operably coupled thereto. It should be understood within the scope of the present invention that the arm member 50 could be manufactured in alternate lengths. Arm member 50 extends outward from the frame 99 and is movable in a first direction (x-axis) as previously described herein with the base housing 10. The arm member 50 is operably coupled to the base housing 10 utilizing pivot pin member 60. The pivot pin member 60 is journaled through the base housing 10 and first end 51 of the arm member 50 providing the operable coupling therebetween. The pivot pin member 60 provides an operable coupling of the arm member 50 so as to facilitate movement of the arm member 50 in a Y-axis direction, i.e. upwards and downwards motion. The movement of the arm member 50 in this second direction (y-axis) provides adjustment of the second end 52, specifically the height thereof with respect to frame 99 so as to alter leverage point.

The first end 51 of the arm member 50, being integrally coupled to first pulley member 75, is movably mounted within the base housing 10 employing pivot pin member 60 as discussed herein. The first pulley member 75 has formed therein a plurality of apertures 57 wherein the apertures 57 are configured to be operably engaged with spring pin member 80. Spring pin member 80 is movably mounted within base housing 10 utilizing a spring or similar element to facilitate an inwards-outwards movement of the spring pin member 80. The spring pin member 80 is moved outwards so as to allow arm member 50 to be pivotally moved to a desired direction. Subsequent desired positioning of the arm member 50, the spring pin member 80 is engaged with one of the apertures 57 to maintain the desired position of the arm member 50. It is contemplated within the scope of the present invention that the arm member 50 could have formed therein various quantities of apertures 57 to provide alternate adjustments of height for the arm member 50. While a pivot pin member 60 has been illustrated and discussed herein to facilitate a y-axis movement of the arm member 50, it should be understood within the scope of the present invention that alternate elements could be employed in place of and/or in conjunction with the pivot pin member 60 to facilitate y-axis movement of the arm member 50.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An articulating arm member configured to be operably coupled to a weight for movement thereof wherein the articulating arm member comprises:

a base housing, said base housing being square in shape having a first end and a second end, said base housing having a central void, said base housing having an upper edge and a lower edge, said base housing being movably coupled to a frame utilizing a pin member, said base housing being superposed upon a support plate member, said support plate member having a perimeter edge being semi-annular in shape, said support plate member having a first plurality of apertures formed therein proximate to said perimeter edge, said base housing having a portion extending underneath said support plate member, said base housing having operably coupled thereto a locking pin, said locking pin being movable in an upwards-downwards motion, said locking pin configured to engage one of said first plurality of apertures in said support plate member, said pin member configured to facilitate movement of said base portion in a first direction; and an arm member, said arm member having a first end and a second end, said first end of said arm member being operably coupled to said base housing, said arm member extending outward from said base housing, said arm member being movably coupled within said base housing utilizing a pivot pin member, said arm member having a first pulley member formed proximate to said first end of said arm member and a second pulley member proximate to said second end of said arm member, said first pulley member having a second plurality of apertures formed therein, said base housing having operably coupled thereto a spring pin member, said spring pin member configured to operably engage one of said second plurality of apertures formed in said first pulley member, said pivot pin member configured to facilitate movement of said arm member in a second direction.

2. The articulating arm member configured to be operably coupled to the weight for movement thereof as recited in claim 1, wherein said second plurality of apertures in said first pulley member are arranged in a pattern having a radius.

3. The articulating arm member configured to be operably coupled to the weight for movement thereof as recited in claim 2, wherein said first direction is a movement in an x-axis direction.

4. The articulating arm member configured to be operably coupled to the weight for movement thereof as recited in claim 3, wherein said second direction is a movement in a y-axis direction.

* * * * *